US012716299B2

(12) United States Patent
Martin et al.

(10) Patent No.: US 12,716,299 B2
(45) Date of Patent: Aug. 25, 2026

(54) THREADED JOINT WITH ANTI-UNSCREWING DEVICE

(71) Applicant: VALLOUREC OIL AND GAS FRANCE, Aulnoye-Aymeries (FR)

(72) Inventors: Pierre Martin, Meudon (FR); Eric Verger, Meudon (FR)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 0 days.

(21) Appl. No.: 18/837,350

(22) PCT Filed: Feb. 15, 2023

(86) PCT No.: PCT/EP2023/053796
§ 371 (c)(1),
(2) Date: Aug. 9, 2024

(87) PCT Pub. No.: WO2023/156479
PCT Pub. Date: Aug. 24, 2023

(65) Prior Publication Data

US 2025/0137329 A1 May 1, 2025

(30) Foreign Application Priority Data

Feb. 17, 2022 (FR) ..... 2201403

(51) Int. Cl.
*E21B 17/043* (2006.01)

(52) U.S. Cl.
CPC ..... *E21B 17/043* (2013.01)

(58) Field of Classification Search
CPC ..... F16L 15/001; F16L 15/08; E21B 17/043
See application file for complete search history.

(56) References Cited

U.S. PATENT DOCUMENTS

| | | | | |
|---|---|---|---|---|
| 4,124,231 | A | 11/1978 | Ahlstone | |
| 4,265,470 | A | 5/1981 | Danner | |
| 4,407,527 | A * | 10/1983 | Reimert | F16L 15/001 |
| 4,629,221 | A * | 12/1986 | Lumsden | F16L 15/004 |
| 6,047,997 | A * | 4/2000 | Olivier | F16L 15/08 |
| 11,781,682 | B2 * | 10/2023 | Wajnikonis | E21B 17/046 |
| 2013/0076028 | A1 | 3/2013 | Pallini, Jr. et al. | |

FOREIGN PATENT DOCUMENTS

| | | | | |
|---|---|---|---|---|
| WO | WO-2014107506 A1 * | 7/2014 | | F16L 15/001 |
| WO | WO-2015077464 A2 * | 5/2015 | | E21B 17/042 |

OTHER PUBLICATIONS

International Search Report issued Mar. 7, 2023 in PCT/EP2023/053796 filed Feb. 15, 2023, 2 pages.

* cited by examiner

*Primary Examiner* — Zachary T Dragicevich
(74) *Attorney, Agent, or Firm* — Oblon, McClelland, Maier & Neustadt, L.L.P.

(57) ABSTRACT

Threaded joint including a male end having a male thread and a free male end, a female end having a female thread and a free female end, said female end also including at least one extension extending axially from the side of the female thread and forming the free female end, said at least one extension being flexible radially and including on an internal surface an extension shoulder arranged to cooperate with a locking surface extending from an external surface of the male end and to limit axially in one direction the relative movement of the male end relative to the female end.

16 Claims, 2 Drawing Sheets

THREADED JOINT WITH ANTI-UNSCREWING DEVICE

TECHNICAL FIELD

The present invention relates to an assembly for producing a threaded joint designed for use in a steel catenary, in particular subjected to torsional forces when arranged on a sea bed in order to connect a wellhead on the sea bed to equipment on the surface, or in a so-called OCTG string.

TECHNOLOGICAL BACKGROUND

Metal tubes are widely used in various fields of the energy industry, such as the production of electricity, oil and gas, as well as in machine construction.

SUMMARY

In the prior art it is known to weld tubes end to end in order to produce a string which is designed to withstand such torsional forces. Alternatively, it is also known to produce such strings from flexible materials. The subject of the invention is to provide an alternative to the known techniques, on the basis of a threaded joint comprising means for limiting the unscrewing of the joint formed, even when it is subjected to swell and sea currents The present invention is also used for the implementation of strings designed for the drilling of, or even the preparation for the operation of, hydrocarbon wells ("drilling" and "drilling with casing"). A component "used for the drilling and the operation of hydrocarbon wells" is understood to mean any element of substantially tubular shape which is designed to be assembled to another element of the same type or not, in order to form ultimately either a fitting capable of drilling a hydrocarbon well, or a casing string or production string used in the operation of the well, this string also being able to be used for the drilling.

A threaded joint comprises a first and a second tubular component made of steel, the first tubular component comprising at one of its axial ends a male threaded zone produced on its external circumferential surface, the second tubular component comprising at one of its axial ends a female threaded zone produced on its internal circumferential surface, and the threaded joint being obtained by screwing as far as a final assembly position of the male threaded zone with the female threaded zone The components used for drilling applications, or even the operation of hydrocarbon wells, are screwed together with a high screwing torque. This high torque is generally achieved due to the clamping cooperation of the abutting surfaces formed on each of the components or by means of so-called self-locking threads. However, certain applications cause even greater stresses, such as underwater riser strings, so-called "risers". As a result, it is necessary to use higher tightening torques in order to avoid the components being unscrewed. However, the screwing torques are limited by the risks of plasticization of the steel surfaces which are brought into cooperation by the tightening. It is thus necessary to adapt the joints relative to the risks of being inadvertently unscrewed.

Developments have been made in order to remedy these drawbacks. Thus the document U.S. Pat. No. 5,794,985 proposes a joint with a sleeve, the ends of the male components thereof being interlocked in one another inside the sleeve so as to prevent the rotation and, as a result, the unscrewing of the components independently of one another. However, if this arrangement makes the unscrewing (break out) difficult, it also complicates the screwing together of the male components in the sleeve. More specifically, it is necessary to position the male components relative to one another such that their ends are able to be interlocked in one another at the end of the screwing operation, which requires extremely accurate control of the angular positions.

The document U.S. Pat. No. 5,785,357 also discloses a threaded joint which does not require the interlocking of the two male components but requires the interlocking of a toothed ring borne by the male component, each tooth of the ring having to be received in a complementary toothing provided by the sleeve equipped with the female thread. Such a ring is fixed in rotation about the male element by splines cooperating with the grooves of the male component. Such a design makes the assembly operation complicated since the final screwing operation between the male component and the female component is dependent on the position of the toothed ring. More specifically, the screwing tools used on site have tolerances and it is very complicated to guarantee the alignment of the numerous teeth borne by the ring in the complementary toothing thereof.

The subject of the invention is a threaded joint which is simple to implement on site, both for screwing and for unscrewing, and which proposes a significant resistance to unscrewing.

The solution of the invention provides a structural decorrelation of the means enabling the fixing of the ring in rotation about the male component, said means enabling the male component and the female component to be prevented from being unscrewed.

The joint according to the invention is provided with an "anti-unscrewing" function. The "anti-unscrewing" function is understood to mean the ability of the joint not to be unscrewed inadvertently, i.e. when this is not desired. More specifically, a joint provided with such a function must not be unscrewed when it is subjected, for example, to torsional or tensile stresses, or even vibrations, during operation.

The anti-unscrewing function of a joint according to the invention is associated with the fact that it is not possible to disconnect the first tubular component from the second component by exerting a torsional torque between the two components.

The invention is based on the idea of preventing the unscrewing of the two components by limiting the possibility for unscrewing, which combines rotational and translation movements by a helicoidal movement, by blocking the axial translation of the two ends, while at the same time not preventing the assembly of the two components in the conventional manner by screwing.

According to one embodiment, the invention provides a threaded joint comprising a male end having a male thread and a free male end, a female end having a female thread and a free female end, said female end also comprising at least one extension extending axially from the side of the female thread and forming the free female end, said at least one extension being flexible radially and comprising on an internal surface an extension shoulder which is arranged to cooperate with a radial shoulder of a locking surface extending from an external surface of the male end and to limit axially in one direction the relative movement of the male end relative to the female end. This makes it possible to increase the resistance of the joint to unscrewing, relative to tensile, torsional or bending stresses.

According to embodiments, such a device can comprise one or more of the following features.

According to one embodiment, the female end can comprise a plurality of extensions separated by recesses and distributed circumferentially, each extension being radially flexible and comprising on its internal surface an extension shoulder arranged to cooperate with the radial shoulder of the locking surface and to limit axially in one direction the relative movement of the male end relative to the female end.

According to one embodiment, the locking surface can be located on the side of the male thread opposing the free male end. Thus the joint can be assembled by screwing according to the usual practices of the trade.

According to one embodiment, a retaining ring can extend at least partially about the at least one extension. Thus the anti-unscrewing performances are further improved.

According to one embodiment, the retaining ring can be fixed to the extensions by a means selected from screws, adhesive or pins. Thus the retaining ring is held in position during the use of the joint.

According to one embodiment, the retaining ring can be a clamping collar.

According to one embodiment, the retaining ring can comprise a portion axially located beyond the extensions and extending radially toward the external surface of the male end, said portion being arranged to protect said extensions. Thus the extensions and their functional surfaces are protected, in particular, during the transport or handling of the tubes comprising the female end.

According to one embodiment, the extensions (6) can have individually an extension length CL and an extension height CH, and the locking surface (11) has a minimum locking surface height BOSHmin (in mm) such that:

$$BOSH\min > 0.2 \times \frac{2 \times Ys \times CL^2}{3 \times E \times CH} \quad \text{[Math 1]}$$

where E is the Young's modulus of the steel of the extension 6 and Y s is the elastic limit of the extension 6.

According to one embodiment, the locking surface (11) can have a maximum locking surface height BOSHmax such that $$BOSH\max \leq 1.8 \times \frac{2 \times Ys \times CL^2}{3 \times E \times CH} \quad \text{[Math 2]}$$

where E is the Young's modulus of the steel of the extension 6 and Y s is the elastic limit of the extension 6.

Thus the anti-unscrewing performances are improved.

According to one embodiment, the retaining ring can have a height RH of the retaining ring of at least 0.5 mm. This enables the ring to be resistant to the stresses of the extensions, if the joint is subjected to tensile, torsional or bending stresses.

According to one embodiment, the locking surface can comprise an engagement surface having an angle of between 3° and 30°, preferably between 5° and 20°. This makes it possible to facilitate the assembly of the threaded joint.

According to one embodiment, the radial shoulder (18) can be a frustoconical surface having an angle greater than 0° and less than 30°, preferably an angle of at least 3°. This makes it possible to improve the anti-unscrewing performances.

According to one embodiment, the extensions 6 can comprise three successive portions: an upstream portion 25 located on the side of the female thread 5 and having an upstream external diameter CD, a downstream portion 24 having a downstream external diameter ED which is less than the upstream external diameter CD and an end portion 23 with an end external diameter BD which is greater than the upstream external diameter CD, the retaining ring 14 having an annular internal diameter AD which is less than the end external diameter CD and greater than the downstream external diameter ED. This makes it possible to mount the retaining ring on the female end and to handle the female end with the ring, and in a second step to lock the retaining ring onto the upstream portion of the extensions and to activate the anti-unscrewing function of the invention in a simple manner after the assembly of the joint.

According to one embodiment, the male end 2 can comprise a male sealing surface 26 and the female end 3 can comprise a female sealing surface 27, the male sealing surface 26 being arranged to cooperate with the female sealing surface 27 in order to form a seal. Thus a joint according to the invention makes it possible to maintain or improve sealing performances when the joint is subjected to tensile, torsional or bending stresses.

BRIEF DESCRIPTION OF THE FIGURES

The invention will be understood more clearly and further objects, details, features and advantages thereof will appear more clearly in the following description of a plurality of specific embodiments of the invention, provided solely in an illustrative and non-limiting manner, with reference to the accompanying drawings.

DESCRIPTION OF EMBODIMENTS

Oil or gas exploitation, or the like, requires a significant number of tubes. Due to the numerous stresses to which these tubes are subjected, both during their installation and during their operation, these tubes meet standards in order to avoid any damage and any leakage into the environment FIG. 1 shows a threaded joint resulting from the assembly of a set of tubular components, this joint having an axis of revolution X.

Figure 1:
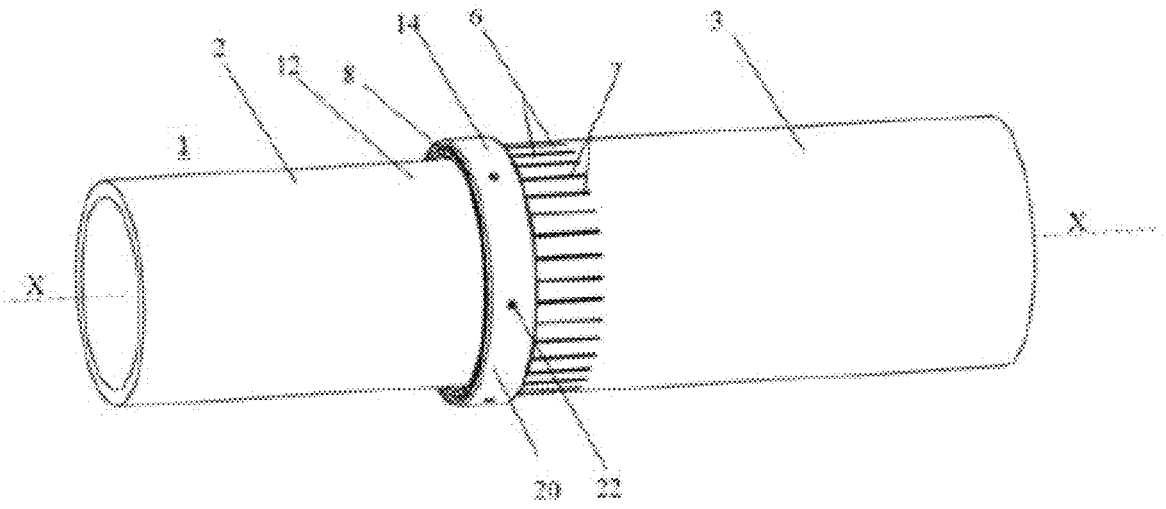
FIG. 1 is a perspective view of a joint resulting from the assembly by screwing a set of tubular components according to the invention.

This assembly comprises, as shown in FIG. 1, a first tubular component having an axis of revolution X and provided at one of its ends with a male end 2 having a male thread 4 (visible in FIG. 2) produced on the external circumferential surface of said male end 2. "Circumferential surface" is understood to mean the surface which extends longitudinally and over the entire circumference of the tubular component. In contrast, the surfaces which extend radially in the region of the free edges of the tubular component are not considered as circumferential surfaces.

The thread can be continuous, interrupted, multiple, single, regular, irregular, etc. The end 1 is terminated by a terminal surface or free male end 13.

The terminal surface is understood to mean the surface which extends in the region of the free edge of the end 2 of the component over the thickness thereof. In other words, the distal surface is in the form of an annular surface generally oriented radially relative to the axis X of the joint.

The male end 2 also comprises on its external circumferential surface a locking surface 11 comprising a radial shoulder 18. The radial shoulder 18 is a surface having an angle B of between 0° and 30° measured in a radial section containing the axis X, and the angle being measured relative to a direction perpendicular to the axis X, namely a radial direction. When the angle B is strictly greater than zero degrees, the radial shoulder 18 is a frustoconical surface, the apex thereof being located on the side of the free male end 13. The locking surface of FIG. 1 is circumferentially continuous. Alternatively, the locking surface 11 can be circumferentially discontinuous. Preferably, the angle B of the radial shoulder 18 can be 1° minimum, more preferably 3° minimum and even more preferably at most 15°.

It is possible that the radial shoulder 18 is not a frustoconical surface but a curved surface, having a tangent on a radially external part and greater than 90°.

More generally, the radial shoulder 18 of the locking surface 11 is arranged to oppose axial displacement, toward the free male end 13, of an object provided with a corresponding surface.

The locking surface 11 is located on the side opposing the free male end 13 relative to the male thread 4 and is located at a predetermined non-zero distance from said male thread 4. Said predetermined distance is at least 15 mm.

This assembly also comprises, as shown in FIG. 1, a second tubular component having the same axis of revolution X and provided at one of its ends with a female end 3 having a female thread 5 produced on the internal circumferential surface of said female end 3. Said female end 3 is terminated by a terminal surface or free female end 8.

The female end 3 comprises a plurality of extensions 6 distributed circumferentially and separated by recesses 7. The extensions 6 extend axially from the side of the female thread 5 and toward the free female end 8. The extensions 6 encompass the free female end 8. The extensions 6 have a radial flexibility such that a terminal extension end 17 can have a first position without radial stress, and can have a second position further away from the axis X than the first position when the extension 6 is subjected to radial stress, in particular when the extension 6 is subjected to a contact force between the extension 6 and the locking surface 11, in particular the contact force between an engagement surface 15 and an extension engagement surface 19.

An extension 6 comprises an extension shoulder 10 which is arranged to cooperate with the locking surface 11 and so as to prevent an axial movement of the extension 6 relative to the male end 2 in the direction of a displacement of the extension 6 toward the free male end 3. In FIG. 1, the extension shoulder 10 is a frustoconical surface having an angle corresponding substantially to the angle of the radial shoulder 18 of the locking surface 11. The extension shoulder 10 extends radially from an internal surface 9 of the extension 6 and toward the interior.

Alternatively, the female end can comprise only a single extension 6.

Alternatively, the female end can comprise 4 extensions 6 arranged circumferentially at 90° and thus distributed over 360° or the female end can comprise 4 extensions 6 distributed over 90° or the female end can comprise 36 extensions 6 distributed over 360°.

Figure 2:
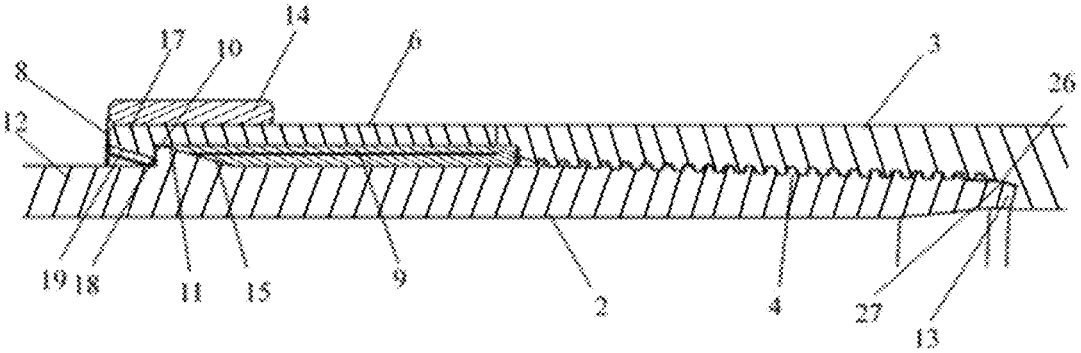
FIG. 2 is a sectional view of the joint of FIG. 1
Figure 3:
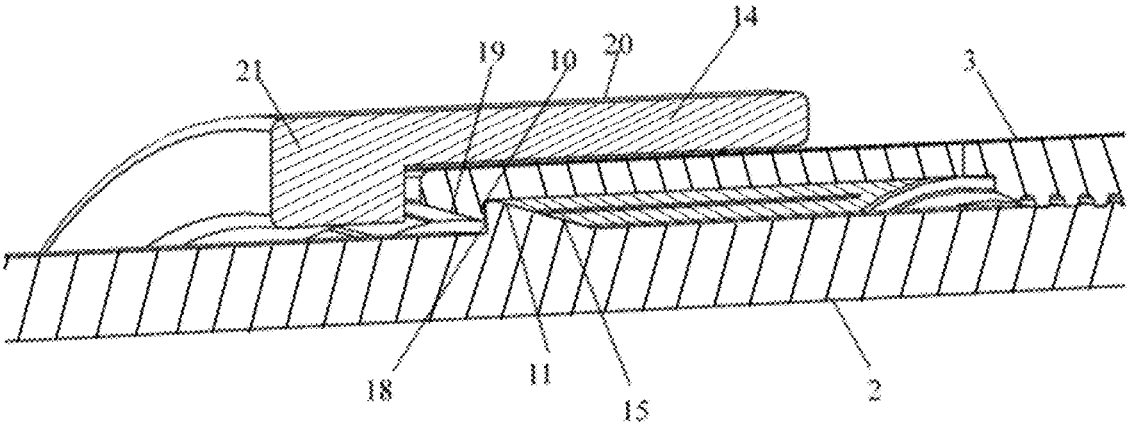
FIG. 3 is a sectional and perspective view of a variation of the embodiment of FIG. 1
Figure 4:
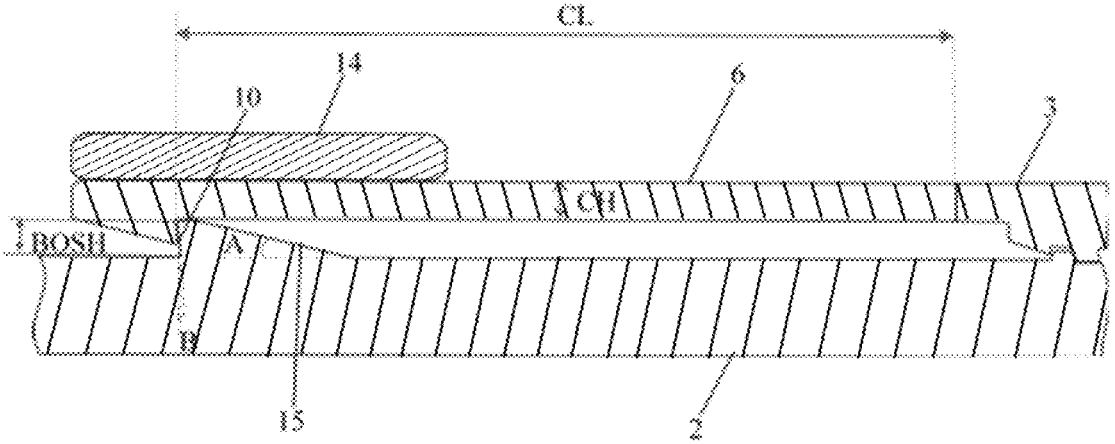
FIG. 4 is a sectional view of a joint according to an embodiment of the invention

The locking surface 11, visible in FIGS. 2 and 3, comprises an engagement surface 15 which is arranged to permit the sliding of the extensions 6 on the locking surface 11 during the assembly of the joint. The engagement surface 15 is oriented toward the free male end 13. The engagement surface 15 is located between the radial shoulder 18 and the free male end 13. The engagement surface 15 is a frustoconical surface, the smallest diameter thereof being located on the side of the free male end 13. The angle of the engagement surface 15 is between 3° and 30°, measured in a sectional plane and relative to the axis of revolution X of the male end 2. Preferably, the angle of the engagement surface 15 is between 5° and 20°. This is a good compromise between the axial bulk of the surface and additional resistance to the assembly of the joint. When the female end 3 is screwed onto the male end 2, the extensions 6 follow a helicoidal movement relative to the male end 2 imposed by the screwing of the female thread into the male thread, and the extensions 6 slide by friction on the engagement surface 15 in this helicoidal movement, the engagement surface 15 causing a radial separation of said extensions 6. The axial position of the locking surface 11 is such that at the end of screwing operation, the extension shoulder 10 of one extension 6 is located at least partially beyond the radial shoulder surface 18, either bearing against said radial shoulder 18 or with an axial clearance between the radial shoulder 18 and the extension shoulder 10. The axial clearance can be at most 3 mm.

The locking surface 11 can be obtained by machining the external surface of the male threaded end 2, or by adding a metal ring which is shrink-fitted, bonded or even welded to the external surface of the male threaded end.

The extensions 6 comprise an extension engagement surface 19 corresponding to the engagement surface 15, i.e. having a frustoconical shape with an angle substantially identical to the angle of the engagement surface 15.

The extension(s) 6 are located downstream of the female thread on the female connection, and each extension comprises an extension shoulder 10 opposing the unscrewing of the male end from the female end, each extension shoulder 10 bearing against the locking surface 11, more specifically each extension shoulder 10 bearing against the radial shoulder 18 of the locking surface 11, which makes it possible to obtain a joint which tolerates greater levels of torsional or bending stress without being inadvertently unscrewed, while maintaining ease of assembly on site, since it suffices to screw the ends to one another in a manner similar to the usual practices.

The threaded joint of FIGS. 1 to 3 also comprises a retaining ring 14 which is arranged to prevent the radial separation of the extensions 6. The retaining ring 14 is a separate element from the male end 2 and the female end 3. The retaining ring comprises a first portion 20 extending axially in the region of the extensions 6 and radially outside the extensions 6. With a retaining ring, the joint according to the invention tolerates greater levels of torsional or bending stresses without being unscrewed. The anti-unscrewing performances are thus improved by a modification of the practices of the assembly of joints on site, which remains minimal relative to the solutions of the prior art.

In a variant shown in FIG. 3, the retaining ring 14 comprises a second portion 21 extending axially beyond the extensions 6 on the side opposing the thread of the female end 3, said second portion extending radially as far as an internal diameter of the second portion which is less than an external diameter of the extensions 6 by at least 0.4 mm. This second portion 21 makes it possible to protect the extensions 6 during the transport of tubular components or during the operation of the catenaries.

The retaining ring 14 has a radial thickness of at least 0.5 mm.

In a variation visible in FIG. 1, the retaining ring 14 is held in position on the extensions 6 by screwing, with the screws 22 screwed radially through an external surface of the retaining ring and into the threaded holes formed in a plurality of extensions. 1 to 8 screws can thus be screwed into 1 to 8 corresponding extensions 6. 4 to 12 screws 22 generally suffice when the joint comprises at least 4 extensions 6 distributed circumferentially.

According to a variant, the retaining ring can be bonded to the extensions or shrink-fitted onto said extensions.

According to a variant, the retaining ring can be a clamping collar, for example manufactured by Jubilee or CFInox.

According to one aspect, the extensions 6 individually have an extension length CL and an extension height CH and the locking surface 11 has a minimum locking surface height BOSHmin (in mm) such that:

$$BOSH\min > 0.2 \times \frac{2 \times Ys \times CL^2}{3 \times E \times CH} \quad \text{[Math 1]}$$

where E is the Young's modulus of the steel of the extension 6 and Y s is the elastic limit of the extension 6.

In addition, the locking surface 11 has a maximum locking surface height BOSHmax such that $$BOSH\max \leq 1.8 \times \frac{2 \times Ys \times CL^2}{3 \times E \times CH} \quad \text{[Math 2]}$$

The length of the extension CL is understood to mean the axial dimension of the extension 6 on its free part, i.e. in the region of the recesses 7, from one end of the recess 7 on the female thread side and as far as the extension shoulder 10. The height of the locking surface BOSH is understood to mean the radial dimension of the locking surface 11 relative to an external diameter of the male end, measured at an axial distance of at most 10 mm from the locking surface 11.

The extension height CH is understood to mean the radial dimension of the extension 6 in the region of its free portion. The extension height CH is generally between 2 mm and 10 mm.

The extension length CL is at least 15 mm. For example, in the case of ends of tubes having a nominal external diameter of 177.8 mm (7 inches) extensions 6 have been produced with an extension length CL of 80 mm.

Figure 5:
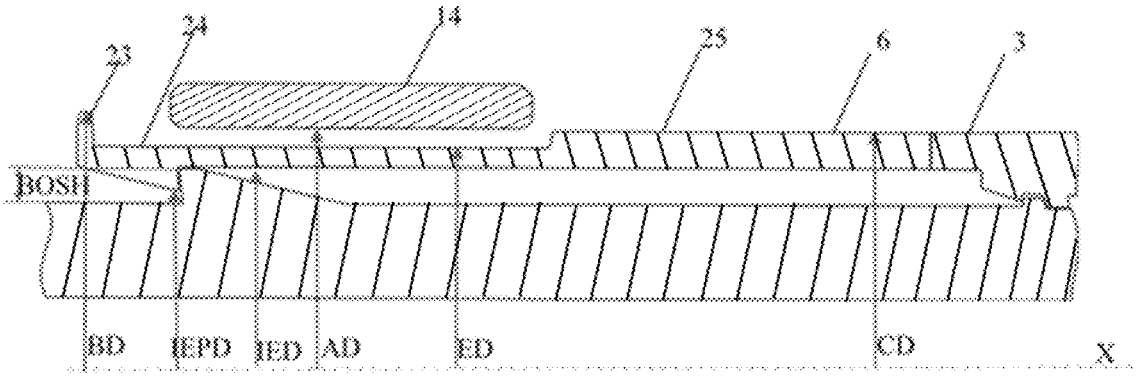
FIG. 5 is a sectional view of a joint according to an embodiment of the invention in a first position
Figure 6:
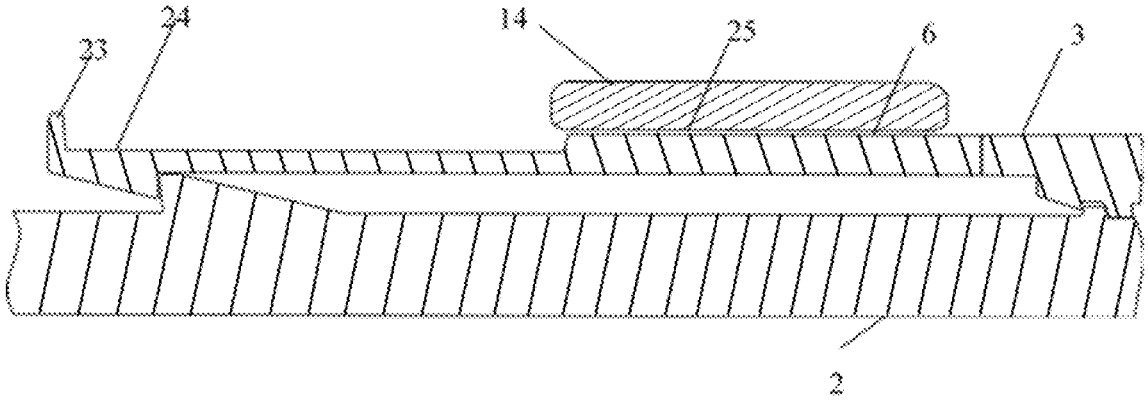
FIG. 6 is a sectional view of a joint according to the embodiment of FIG. 5 in a second position.

In a further variant shown in FIGS. 5 and 6, the extensions 6 comprise three successive portions: an upstream portion 25 located on the side of the female thread and having an upstream external diameter CD, a downstream portion 24 having a downstream external diameter ED which is less than the upstream external diameter CD and an end portion 23 with an end external diameter BD which is greater than the upstream diameter CD. The retaining ring 14 has an annular internal diameter AD which is less than the end external diameter CD and greater than the downstream external diameter ED.

The extension shoulder 18 has an internal diameter of the extension shoulder IEPD, and the extension 6 has a downstream internal diameter IED on the downstream portion 24. The annular internal diameter AD and the downstream external diameter are such that:

$$AD - ED > BOSH - (IED - IEPD) \quad \text{[Math 3]}$$

The retaining ring 14 has an axial length which is less than the axial length of the downstream portion 24. The annular internal diameter AD is close to the upstream external diameter CD, i.e. these two diameters are in a tight fit or with a clearance, for example a clearance of between −0.1 mm and +1 mm.

In this variant, the retaining ring 14 is placed on the extensions 6 and is held by the end portion 23. When the retaining ring 14 is in the region of the downstream portion 24, the assembly of the female end 3 onto the male end 2 is possible, since the retaining ring does not block the radial movement of the extensions 6 during assembly. When the retaining ring 14 is positioned in the region of the upstream portion 25, the retaining ring opposes the radial separation of the extensions 6, thus preventing the unscrewing of the joint thus formed. The advantages of this variant are that the retaining ring is integrated in the female end which facilitates the handling on site. Moreover, since in the majority of cases the tubular components inserted into a casing string or catenary string are assembled such that the male end is at the bottom and the female end is at the top, the retaining ring 14 can slide and be held in position by gravity on the upstream portion 25. Finally it is possible to combine this variant with other fixing means present in the other variants, such as screws or adhesive. Moreover, the ring can be advantageously produced from steel or from an alloy comprising bronze.

In all of the embodiments described below, the male end can comprise at least one male sealing surface which is arranged to cooperate with at least one female sealing surface on the female end to form a metal seal.

Advantageously, the interaction between the extensions 6 and the locking surface 11 makes it possible to limit the axial movement of the ends relative to one another and make it possible, in synergy with the threads, to limit the possibility of the male and female sealing surfaces sliding relative to one another. Thus the invention makes it possible to improve the sealing performances of the joint formed, in the case of stresses, particularly tensile, bending or torsional stresses.

A test has been carried out comparing a joint of the prior art and a joint of the same type which has been modified to incorporate an embodiment according to the invention. This joint according to the invention comprises 36 extensions 6 distributed circumferentially over 360° and does not comprise a retaining ring. The two joints have been subjected to a torsion test. The joint according to the invention has achieved a torsional strength which is improved by 80%, and the joint according to the invention without an extension makes it possible to provide a torsional strength representing 16% of the torsional strength of the tube (100% corresponding to the strength of the tube on which the male end or the female end is produced). Simulations have shown that a joint which also comprises a retaining ring makes it possible to achieve strength values in the order of 40 to 50% minimum torsional strength of the tube.

A joint according to the invention can thus be assembled by screwing a male end into the female end. During the screwing step, the extensions 6 contact the locking surface 11, the engagement surface 15 radially spreading the ends of the extensions 6 to the outside until the extension shoulders 10 reach an axial position where the extensions 6 return at least partially radially toward the inside and the extension shoulders are in a position bearing against the holding surface 16 of the locking surface 11. Then the retaining ring 14 is positioned axially in the region of the extensions 6, so as to block an axial separation of the extension 6. The retaining ring is then fixed to the extensions 6 by screwing, for example. Thus the assembly operations of a threaded joint with anti-unscrewing properties are simplified, with only one supplementary element to be assembled, in addition to the two threaded ends.

The invention claimed is:

1. A threaded joint comprising:

a male end having a male thread and a free male end; and a female end having a female thread and a free female end, the female thread configured to directly engage the male thread to connect the male end to the female end, wherein said female end also includes at least one extension extending axially from the side of the female thread and forming the free female end, wherein said at least one extension is configured to flex radially and includes on an internal surface an extension shoulder arranged to cooperate with a radial shoulder of a locking surface extending from an external surface of the male end and to limit axially in one direction the relative movement of the male end relative to the female end, and wherein the at least one extension of the female end comprises a plurality of extensions separated by recesses and distributed circumferentially, each extension being radially flexible and comprising on its internal surface an extension shoulder arranged to cooperate with the radial shoulder of the locking surface and to limit axially in one direction the relative movement of the male end relative to the female end.

2. The threaded joint according to claim 1, wherein the locking surface is located on the side of the male thread opposing the free male end.

3. The threaded joint according claim 1, also comprising a retaining ring extending at least partially about the at least one extension.

4. The threaded joint according to claim 3, wherein the retaining ring is fixed to the at least one extension by a means selected from screws, adhesive or pins.

5. The threaded joint according to claim 3, wherein the retaining ring is a clamping collar.

6. The threaded joint according to claim 3, wherein the retaining ring comprises a portion axially located beyond the at least one extension and extending radially toward the external surface of the male end, said portion being arranged to protect said at least one extension.

7. The threaded joint according to claim 6, wherein the locking surface has a maximum locking surface height BOSHmax such that $$BOSH\max \leq 1.8 \times \frac{2 \times Ys \times CL^2}{3 \times E \times CH} \quad \text{[Math 2]}$$

where E is the Young's modulus of steel of the extension and Ys is the elastic limit of the extension.

8. The threaded joint according to claim 3, wherein the retaining ring has a height RH of the retaining ring of at least 0.5 mm.

9. The threaded joint according to claim 1, wherein the at least one extension has individually an extension length CL and an extension height CH, and the locking surface has a minimum locking surface height BOSHmin (in mm) such that:

$$BOSH\min > 0.2 \times \frac{2 \times Ys \times CL^2}{3 \times E \times CH}$$

where E is the Young's modulus of steel of the extension and Ys is the elastic limit of the extension.

10. The threaded joint according to claim 1, wherein the locking surface comprises an engagement surface having an angle of between 3° and 30°.

11. The threaded joint according to claim 10, wherein the engagement surface has an angle of between 5° and 20°.

12. The threaded joint according to claim 1, wherein the radial shoulder is a frustoconical surface having an angle greater than 0° and less than 30°.

13. The threaded joint according to claim 12, wherein the frustoconical surface has an angle of at least 3° and less than 30°.

14. The threaded joint according to claim 1, wherein the at least one extension comprises three successive portions: an upstream portion located on the side of the female thread and having an upstream external diameter CD, a downstream portion having a downstream external diameter ED which is less than the upstream external diameter CD and an end portion on the side of the free female end, the end portion having an end external diameter BD which is greater than the upstream external diameter CD and the retaining ring having an annular internal diameter AD which is less than the end external diameter CD and greater than the downstream external diameter ED.

15. The threaded joint according to claim 1, wherein the male end comprises a male sealing surface and the female end comprises a female sealing surface and the male sealing surface is arranged to cooperate with the female sealing surface in order to form a seal.

16. A threaded joint comprising:

a male end having a male thread and a free male end; and a female end having a female thread and a free female end, the female thread configured to directly engage the male thread to connect the male end to the female end, wherein said female end also includes at least one extension extending axially from the side of the female thread and forming the free female end, wherein said at least one extension is configured to flex radially and includes on an internal surface an extension shoulder arranged to cooperate with a radial shoulder of a locking surface extending from an external surface of the male end and to limit axially in one direction the relative movement of the male end relative to the female end, and wherein a retaining ring extends at least partially about the at least one extension.

* * * * *